United States Patent [19]

Thrash et al.

[11] 4,368,632

[45] Jan. 18, 1983

[54] APPARATUS FOR REDUCING THE CROSS SECTIONAL AREA OF A WIRE

[75] Inventors: Robert N. Thrash, Tucker; W. Ralph Crooks, Stone Mountain, both of Ga.

[73] Assignee: Kearney-National Inc., Atlanta, Ga.

[21] Appl. No.: 228,991

[22] Filed: Jan. 27, 1981

[51] Int. Cl.[3] ..... B21J 13/02

[52] U.S. Cl. ..... 72/198; 72/343; 72/420; 72/463; 29/623

[58] Field of Search ..... 29/623; 59/30; 72/190, 72/191, 192, 197, 198, 276, 352, 374, 375, 376, 412, 416, 253.1, 260, 263, 411, 428, 470, 474, 475, 420, 421, 343, 463; 140/1, 2, 71 R, 105; 101/4

[56] References Cited

U.S. PATENT DOCUMENTS

| | | | |
|---|---|---|---|
| 397,925 | 2/1889 | McKinny | 140/1 |
| 715,774 | 12/1902 | Fenner | 101/4 |
| 1,319,837 | 10/1919 | Brinkman | 72/416 |
| 1,800,704 | 4/1931 | Stahl | 101/4 |
| 2,252,490 | 8/1941 | Borky | 140/62 |
| 2,359,084 | 9/1944 | Carlson | 72/416 |
| 2,630,727 | 3/1953 | Herzog | 72/412 |
| 2,778,385 | 1/1957 | Gier, Jr. | 140/105 |
| 2,914,643 | 11/1959 | Fields et al. | 72/198 |
| 3,077,131 | 2/1963 | McShane | 72/198 |
| 3,415,094 | 12/1968 | Stikeleather et al. | 72/197 |
| 3,417,599 | 12/1968 | Burns | 72/412 |
| 3,626,994 | 12/1971 | Klenz | 140/82 |

FOREIGN PATENT DOCUMENTS

| | | | |
|---|---|---|---|
| 152990 | 8/1953 | Australia | 72/276 |
| 190414 | 12/1922 | United Kingdom | 140/71 R |

*Primary Examiner*—Lowell A. Larson
*Attorney, Agent, or Firm*—Rodgers & Rodgers

[57] ABSTRACT

Apparatus for reducing the cross sectional area of a wire comprises stabilizing means arranged to receive the wire and to limit extrusion thereof in a direction transverse to its length and movable projecting means for engaging the wire while restrained by the stabilizing means so as to effect a deformation of the wire and a concomitant reduction of its cross sectional area.

19 Claims, 4 Drawing Figures

APPARATUS FOR REDUCING THE CROSS SECTIONAL AREA OF A WIRE

TECHNICAL FIELD

This invention relates to apparatus for reducing the cross sectional area of a wire at spaced intervals along its length so as to form a fusible element for use particularly in high voltage current limiting fuses.

BACKGROUND ART

According to one known practice, the fusible element for a current limiting high voltage fuse is of ribbon or tape form and its cross sectional area is reduced at spaced intervals along its length by punching or notching procedures. There are advantages in using fusible elements formed of wire rather than of ribbon form but known procedures for varying the cross sectional area of wire involve expensive and time consuming electroplating or machining techniques for enlarging or reducing the wire diameter at spaced intervals along its length.

DISCLOSURE OF THE INVENTION

According to this invention in one form apparatus for reducing the cross sectional area of a length of wire is provided and comprises stabilizing means arranged to receive the wire and to limit transverse extrusion thereof and means including moveable projecting means for engaging and deforming the wire while restrained by the stabilizing means so as to reduce its cross-sectional area.

BEST MODE FOR CARRYING OUT THE INVENTION

Figure 1:
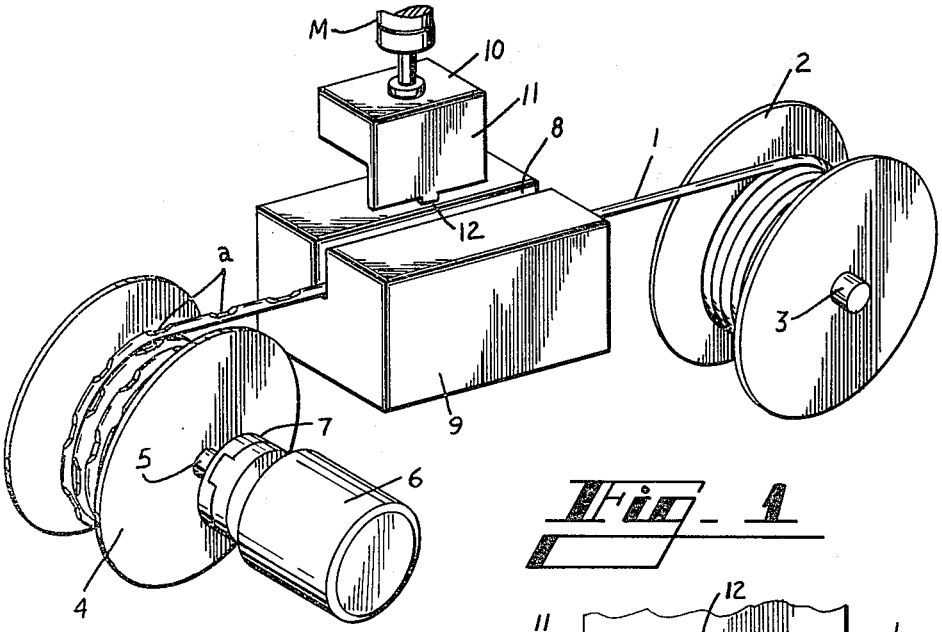
FIG. 1 is an isometric view of one form of the apparatus for reducing the cross sectional area of a wire.
Figure 2:
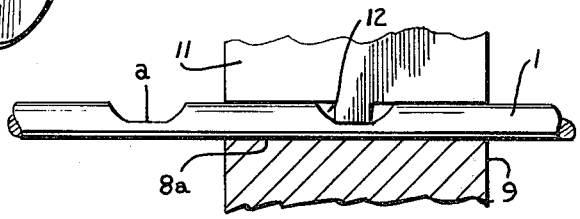
FIG. 2 is an enlarged fragmentary view showing deformation of a wire by the apparatus shown in FIG. 1.

In FIGS. 1 and 2, the numeral 1 designates the wire, the cross sectional area of which is reduced according to this invention. Wire 1 is wound on spool 2 which in turn is mounted on shaft 3. Wire 1 is wound from spool 2 onto spool 4 which in turn is mounted on shaft 5. Spool 4 is rotated by conventional means such as motor 6 and clutch arrangement 7 both of which cooperate with shaft 5 to wind wire 1 onto spool 4.

In order to deform the wire according to this invention and as shown in FIG. 1 in one form initially wire 1 proceeds through slot 8 formed in the upper portion of the wire stabilizing means in the form of stabilizing block 9. For the purpose of deforming the wire, reciprocable element 10 is mounted above stabilizing block 9 by an appropriate conventional reciprocable mechanism which is partially shown in the drawing and is indicated by the letter M. Reciprocable element 10 is provided with plate 11 formed on one side thereof and projection 12 formed on the lower edge of plate 11.

Plate 11 is disposed in longitudinal alignment with slot 8.

In operation wire 1 is wound onto spool 4 by means of motor 6 in an intermittent fashion. As wire 1 proceeds through slot 8 reciprocable element 10 is intermittently lowered whereby plate 11 and projection 12 are lowered into slot 8 a distance sufficient to allow for the accurate deformation indicated by the letter "a", of wire 1 by means of projection 12. Plate 11 and projection 12 are shown in their lowermost positions in FIG. 2.

The width of slot 8 determines the width of deformation "a" while the height of deformation "a" is determined by the lowermost reach of projection 12 of reciprocable element 10 and the lower surface 8*a* of slot 8. Of course the size of deformation "a" can be changed by simply varying these dimensions.

Figure 4:
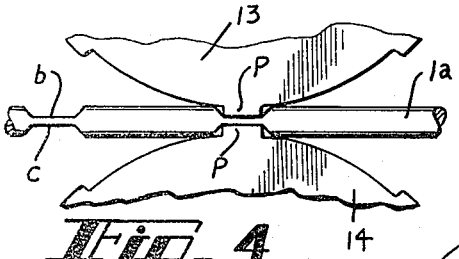
FIG. 4 is an enlarged view showing deformation of the wire by the apparatus shown in FIG. 3.
Figure 3:
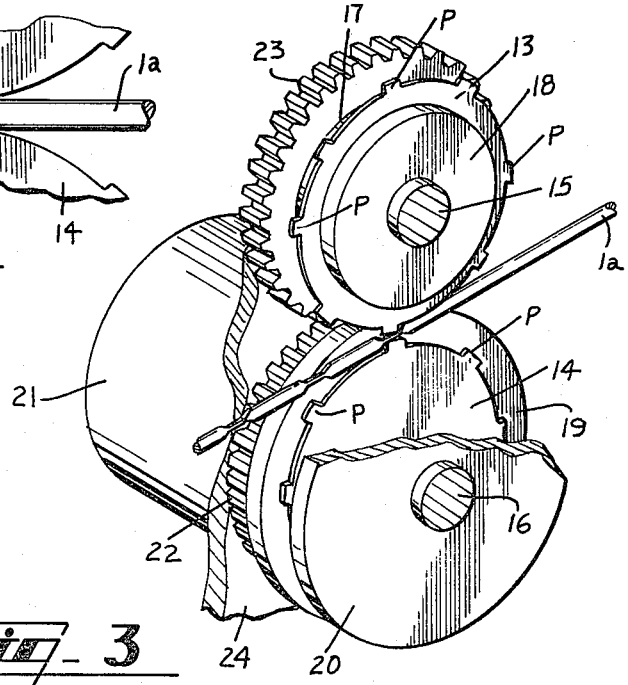
FIG. 3 is an isometric view of alternate apparatus for reducing the cross sectional area of a wire.

An alternate form of this invention is shown in FIGS. 3 and 4. More specifically the apparatus as shown in FIG. 3 comprises wheels 13 and 14 which are mounted on shafts 15 and 16 respectively. Wheels 13 and 14 are each provided with spaced projections p.

Stabilizing means for this apparatus is provided in the form of supporting discs 17 and 18 which are mounted on shaft 15 and disposed on either side of wheel 13 and supporting discs 19 and 20 which are mounted on shaft 16 and are disposed on either side of wheel 14. As is best viewed in FIG. 3, supporting discs 17 and 18 are of a smaller diameter than supporting discs 19 and 20. Rotation of wheel 14 and supporting discs 19 and 20 is provided by appropriate motor means 21. In addition motor 21 rotates gear 22 fixedly mounted on shaft 16 which in turn rotates gear 23 and the other elements mounted on shaft 15. The entire assembly of FIG. 3 is mounted on base plate 24 and wheel 14 is rotated in synchronism with wheel 13. According to this invention, wire 1*a* is advanced between wheels 13 and 14 by any suitable means such as the spool arrangement shown in FIG. 1. As wire 1*a* proceeds between wheels 13 and 14, corresponding projections P on each wheel are synchronized in such a manner that deformations b and c are intermittently formed in wire 1*a* as it passes between the wheels and as shown in detail in FIG. 4.

Since supporting discs 19 and 20 are larger in diameter than corresponding supporting discs 17 and 18 wire 1*a* is positioned between supporting discs 19 and 20 as it proceeds between wheels 13 and 14. Discs 19 and 20 thus constitute stabilizing means for receiving the wire 1*a* and for limiting transverse extrusion thereof. This arrangement not only provides stabilization for wire 1*a* but also limits the lateral extrusion of the wire material when the deformations b and c are formed. Of course the spacing of wheels 13 and 14 can be adjusted to provide varying degrees of vertical deformation in the wire. In addition supporting discs 19 and 20 are positioned such that minimum interference with wire 1*a* occurs so as to facilitate movement of the wire through the apparatus.

Extrusion of the wire in a transverse direction is thus limited by the width of slot 8 and by the lateral distance between adjacent faces of supporting discs 19 and 20. Extrusion of the wire in a longitudinal direction is not limited by the apparatus but occurs as the projection 12 and the bottom 8*a* of slot 8 effect a squeezing action on wire 1. Similarly projections P squeeze and extrude wire 1*a* in a longitudinal direction while disposed between supporting discs 19 and 20. The length along the wire 1 of deformation a and of deformations b and c along wire 1*a* is not critical. It is important however that the reduced cross sectional area be substantially rectangular. Thus the aspect ratio determined by dividing the cross sectional area of the wire by the cross sectional area of deformations such as a, b and c should be in the range of 1.25 to 5. The rectangular cross sectional configuration of the deformations a, b and c assures that the aspect ratio is constant along the length of the wire. These relationships may, of course, be varied depending on the wire diameter and on the rating of the fuse.

INDUSTRIAL APPLICABILITY

By this invention means are provided to reduce the cross sectional area of the wire element for use as the fusible element in a high voltage current limiting fuse. The deformations are accomplished economically at room temperature by means which also controls the physical and electrical properties of the wire with a high degree of accuracy.

We claim:

1. Apparatus for effecting a reduction in the cross sectional area of a wire comprising stabilizing means for receiving said wire and for limiting extrusion thereof in a direction generally transverse thereto, means for moving said wire axially relative to said stabilizing means, and means including movable projecting means for engaging a part of said wire whose extrusion is limited in a transverse direction by said stabilizing means so as to effect deformation and a concomitant reduction in the cross sectional area thereof, said stabilizing means and said part of said wire being fixed in position relative to each other during deformation of said wire.

2. Apparatus according to claim 1 wherein longitudinal extrusion of said wire and limited transverse extrusion thereof is effected by engagement of said wire by said projecting means.

3. Apparatus according to claim 1 wherein said stabilizing means is arranged to limit sidewise extrusion of said wire.

4. Apparatus according to claim 1 wherein the aspect ratio is between 1.25 and 5.00.

5. Apparatus for reducing the cross sectional area of a length of wire at spaced intervals along the length thereof comprising means for incrementally and intermittently advancing said wire, a stabilizing block, said stabilizing block having a slot with a portion of said wire disposed in said slot, a reciprocating element disposed adjacent said slot, and a projection formed on said reciprocating element and movable with said reciprocating element in a direction transverse to said wire, said projection being adapted to enter said slot and to engage said wire and effect deformation thereof only when said wire is fixed in position relative to said stabilizing block and during intervals between incremental advancement of said wire.

6. Apparatus according to claim 5 wherein said wire is initially round in cross section.

7. Apparatus according to claim 5 wherein said reciprocating element comprises a vertically disposed plate.

8. Apparatus according to claim 7 wherein said projection is disposed on the lower edge of said plate.

9. Apparatus according to claim 5 wherein said slot is slightly wider than the diameter of said wire.

10. Apparatus according to claim 5 wherein said slot is formed in the upper portion of said stabilizing block and at least a portion of said reciprocatory element is disposed above said stabilizing block.

11. Apparatus according to claim 10 wherein said plate is disposed in longitudinal alignment with said slot.

12. Apparatus according to claim 5 wherein the lowermost reach of said projection on said reciprocatory element is below the uppermost portion of said wire.

13. Apparatus for reducing the cross sectional area of a length of wire at spaced intervals along the length thereof comprising means for advancing said wire, a pair of wheels adapted to rotate about spaced generally parallel axes in opposite directions with a portion of said wire disposed between said wheels, spaced multiple projections on the periphery of each of said wheels, said projections on one wheel being synchronized and coincidental with corresponding projections on the other of said wheels so as to impart a transverse deforming force to opposite parts of said wire, and two of said corresponding projections being separated at the point of closest proximity by a distance less than the diameter of said wire.

14. Apparatus according to claim 13 wherein a pair of supporting discs are coaxial with one of said wheels and are disposed on either side thereof.

15. Apparatus according to claim 14, wherein a second pair of supporting discs are coaxial with the other of said wheels and are disposed on either side thereof.

16. Apparatus according to claim 15 wherein one of said pairs of supporting discs is larger in diameter than the other of said pairs of supporting discs.

17. Apparatus according to claim 16 wherein the smaller of said supporting discs and the associated one of said wheels are disposed above the larger of said supporting discs and the other of said wheels.

18. Apparatus according to claim 17 wherein said wire is disposed between the larger of said supporting discs.

19. Apparatus according to claim 18 wherein the diameter of said wire is slightly smaller than the separation of said larger supporting discs.

* * * * *